United States Patent [19]

Jedo et al.

[11] 4,075,090

[45] Feb. 21, 1978

[54] APPARATUS FOR GRAVITY COLLECTING AND HANDLING OF PRODUCTS FROM TANKS FILLED WITH LIQUID FOR DEWATERING DEVICES

[75] Inventors: Antoni Jedo, Gliwice; Waclaw Jachna, Tychy, both of Poland

[73] Assignee: Centralny Osrodek Projektowo-Konstrukcyjny Maszyn Gorniczych "Komag", Gliwice, Poland

[21] Appl. No.: 710,243

[22] Filed: July 30, 1976

[30] Foreign Application Priority Data

Aug. 2, 1975 Poland ..... 182522

[51] Int. Cl.[2] ..... B03B 11/00

[52] U.S. Cl. ..... 209/173; 209/457

[58] Field of Search ..... 209/173, 172, 172.5, 209/44, 454, 455, 457, 488, 490, 17

[56] References Cited

U.S. PATENT DOCUMENTS

| | | | |
|---|---|---|---|
| 1,996,022 | 3/1935 | Lewis | 209/173 |
| 2,169,544 | 8/1939 | Vissac | 209/455 |
| 3,249,226 | 5/1966 | Watson | 209/172.5 |
| 3,708,063 | 1/1973 | Morimasa | 209/17 X |

FOREIGN PATENT DOCUMENTS

| | | | |
|---|---|---|---|
| 341,027 | 9/1921 | Germany | 209/454 |

*Primary Examiner*—Frank W. Lutter
*Assistant Examiner*—Ralph J. Hill
*Attorney, Agent, or Firm*—Haseltine, Lake & Waters

[57] ABSTRACT

Apparatus for gravity collection and handling of products from jiggers to dewatering devices, comprising two tanks filled with liquid and interconnected by a passage, and a discharge conduit connected to the inlet nozzle of a dewatering device.

Inside the equalizing tank the liquid level is at least as high as that in the feeding tank. The outlet of the feeding tank is provided with the restrictor while the outlet of the equalizing tank is equipped with a regulating element. Granular material from the feeding tank flows through the outlet and falls by gravity into the communicating passage, wherefrom together with liquid supplied from the equalizing tank is fed via the discharge conduit to the inlet nozzle of the dewatering device.

7 Claims, 3 Drawing Figures

APPARATUS FOR GRAVITY COLLECTING AND HANDLING OF PRODUCTS FROM TANKS FILLED WITH LIQUID FOR DEWATERING DEVICES

This invention relates to apparatus for gravity collecting and handling of granular products from tanks filled with liquid for dewatering systems, especially for enriched material from boxes of water jiggers. This equipment is applicable to dressing plants, in particular with the gravity enrichment or separation of minerals in water jiggers.

Known are facilities for collecting and handling of enriched material from water jiggers, where granular products /grains/ are moved by gravity from the water jigger boxes to the receiver channels with water. Once the products have fallen to the lowest part of the channel, they are lifted with bucket elevators above the surface of water in the channel, gravity dewatering taking place during this time. The use of the bucket elevators, however, is expensive, and also needs considerable space for the arrangement thereof.

U.S. Pat. No. 2,169,544 discloses equipment for collecting and handling heavy products from a system consisting of two water tanks. The feeding tank is the jigger water box, this tank being associated with the equalizing tank via the outlet hole. The latter allows the flow of the heavy fraction and water from the feeding tank into the equalizing tank, wherefrom the heavy fraction is removed by means of a bucket elevator, and the water is removed by opening a draining /bleed/ valve. The water levels in the feeding and equalizing tanks are distinctly differentiated. The level of the water surface in the equalizing tank is controlled by the said bleed valve.

German Patent specification No. 47,967 discloses equipment where the light fraction and the heavy fraction with water are separated via separate siphon pipes. The siphon pipe ends are located beneath the level of the water surface in the jigger to ensure such a differential pressure to effect flow of the products.

The above systems are inconvenient as the collecting of the heavy fractions is accompanied by intensive water outflow from the jigger box. It becomes really disadvantageous when the enriched mineral material contains a considerable amount /percentage/ of heavy fraction.

According to German Patent specification No. 1,252,151, and Soviet Patent specification No. 207,168, systems are disclosed where the collecting of the heavy fraction is effected through channels at the bottom of the water jigger box, the jigger hydrostatic pressure being fully used. With the said systems, especially when hydrocyclones are utilized for the dewatering of enriched material, a considerable amount of water will be removed along with the enrichment process products, thus adversely effecting the flow rates inside the water jigger box.

This invention is directed to the gravity collecting and handling of at least one enriched product from the jigger without affecting the water flow or shifting of products over the jigger sieve deck, and to reducing the weight of the equipment intended for the collecting and dewatering of the said products.

The equipment according to this invention for gravity collecting and handling of granular products from tanks filled with liquid, especially for collecting of enriched mineral material from jiggers and handling them to the dewatering facilities comprises a system of communicating vessels. The liquid levels in the communicating vessels, as well as the hydrostatic pressures of the same depths of the system are similar to each other. The equipment consists of the feeding tank, usually the jigger water box, and at least one equalizing tank filled with liquid, where the said tanks communicate — through outlet holes — via at least one communicating passage wherefrom the drain offtake, terminated by a dewatering device nozzle, is connected. The feeding tank outlet holes for the granular products are provided with restrictors, at least one being made in the form of a float, and the equalizing tank drain holes for liquid have the regulating elements. The equalizing tank overflow edge is located in the feeding tank liquid surface level as a minimum. The cross-sectional area of the offtake to dispose of the granular product and water from the passage /communicating the feeding and equalizing tanks/ is larger than that of the dewatering device nozzle mouth, and smaller than that of the intertank communicating passage.

To maintain a constant level of liquid in the tanks, the equalizing liquid level is controlled by the regulating system to control the make-up liquid inflow from the pipeline. Considering the pressure equilibrium in the system of communicating vessels, the feeding tank is associated with the equalizing tank by passages and an open channel, the bottom /bed/ of this open channel being beneath the level of the free liquid surface in the feeding tank.

The equalizing tank is covered at least in part by an inclined screen partially immersed in liquid, with a catcher of impurities arranged over the screen surface.

With the equipment of the invention the desired object has been obtained as the granular /grain/ products from the feeding tank move via the outlet holes and communicating passages by gravity. On the other hand, the gravity flow of the liquid leaving the equalizing tank into the offtake, is used to increase the flow rate of the grains being moved in the inlet nozzles of the dewatering devices. This has been attained by balancing of hydrostatic pressures in the feeding tank outlet /discharge/ holes, and due to to the use of communicating passages and offtakes whose cross sectional areas are larger than those of the inlet nozzles in the dewatering devices. Moreover, the granular product layer being held over the restrictor in the feeding tank outlet /discharge/ hole, as well as the restrictor itself, offer hydraulic resistance to restrict the liquid flow into or from the feeding tank, even in the case of liquid level differences occuring within the system of communicating vessels. At the same time, the hydraulic resitances between the offtake and the equalizing tank is negligible. Therefore, the transportation of granular products descending from the feeding tank into the communicating passage, can be effected even in the case when the restrictors are fully closed. The regulating element, which is provided in the equalizing tank outlet /draining/ hole, is used for continuous or periodic control of the liquid outflow into the communicating passage when — for some other reasons — a partial outflow of liquid from the feeding tank is required.

With the equipment of the invention, dewatering of enriched material is feasible without using expensive, and rather awkward bucket elevators. Such elevators, lifting the products to the level above the jigger, need chute and the feeder conveyors, usually arranged beneath the jiggers. By eliminating the elevators and associated equipment, it is possible to reduce the building height, the floor space required for the jiggers and also the height thereof. This results, among others, from the possibility of eliminating the pyramidal hoppers which collect residues in the jigger bottom, or the horizontal worm conveyors.

Another advantage is offered by the possibility of free arrangement of dewatering facilities due to the hydraulic-gravity conveyance of material from the jigger to the dewatering facilities. Thereby, with appropriate layout of the tanks and loading devices, reduction of belt conveyance and full utilizing of the available capacity of the tanks becomes feasible.

A further quality of the equipment of the invention consists in the possibility of lower power consumption as compared to other known facilities, due to utilizing for transport, the potential energy of the liquid being drained upon completion of the enrichment process, and the potential energy of the granular /grain/ products.

By using the flow-through system of communicating vessels for balancing the hydrostatic pressure of the column of liquid in the jigger at the level of outlet /discharge/ holes, not only is unwanted outflow of water from the jigger prevented, but also the probability of jamming /seizure/ of the choking restrictors becomes reduced. Such seizures are encountered in the case of considerable differential pressures when the grains being entrained with liquid leaving the jigger become lodged in slots between the moving parts and the housings of the known receivers.

With the equipment, of the invention, both the light and heavy products can be collected from any level of the jigger, thus offering additional possibilities for selecting the jigger operating variables, especially when dealing with sparingly enriching minerals which require a thick layer of minerals in the working bed.

An embodiment of the invention is presented in the enclosed drawings, where

Figure 1:
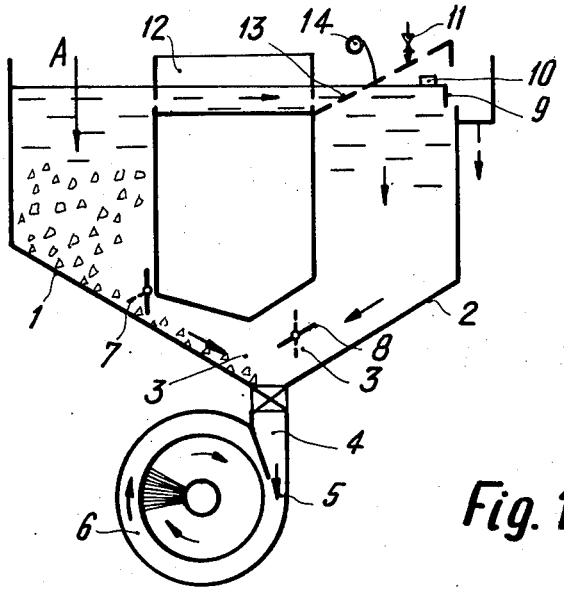
FIG. 1 is a schematic diagram of the equipment.

The flow-through system of communicating vessels, as seen in FIG. 1, consists of two tanks viz. the feeding tank 1 and the equalizing tank 2, communicating passage 3 between the tanks, and the offtake 4 for discharge of the granular product and liquid into the inlet nozzle 5 of the dewatering device 6. The feeding tank 1 outlet /discharge/ hole is provided with the restrictor or valve 7, while the equalizing tank 2 outlet /draining/ hole is provided with the regulating element 8. The equalizing tank 2 has an overflow with its crest 9 located at the level of the free surface of the liquid in the feeding tank 1. The latter and the equalizing tank 2 communicate with one another by an open channel 12. The cross-sectional areas of the passage 3 and the offtake 4 are larger than that of the nozzle mouth 5 of the dewatering device 6. The equipment shown in FIG. 1 can be used to remove floating impurities from raw coal, e.g. wood. Raw mineral A together with water is fed into the feeding tank 1. Wood and water are discharged via the open channel 12 into the equalizing tank 2, where the catcher 14 will remove the wood, and water is discharged into the offtake 4, or over the crest 9. Devoid of wood, the coal falls by gravity to the bottom of tank 1, and then slides down into the passage 3 in an amount limited by the restrictor 7. From the passage 3, coal and water supplied by the tank 2, will flow into the offtake 4, and via the nozzle 5 is fed to the dewatering facility 6.

Figure 2:
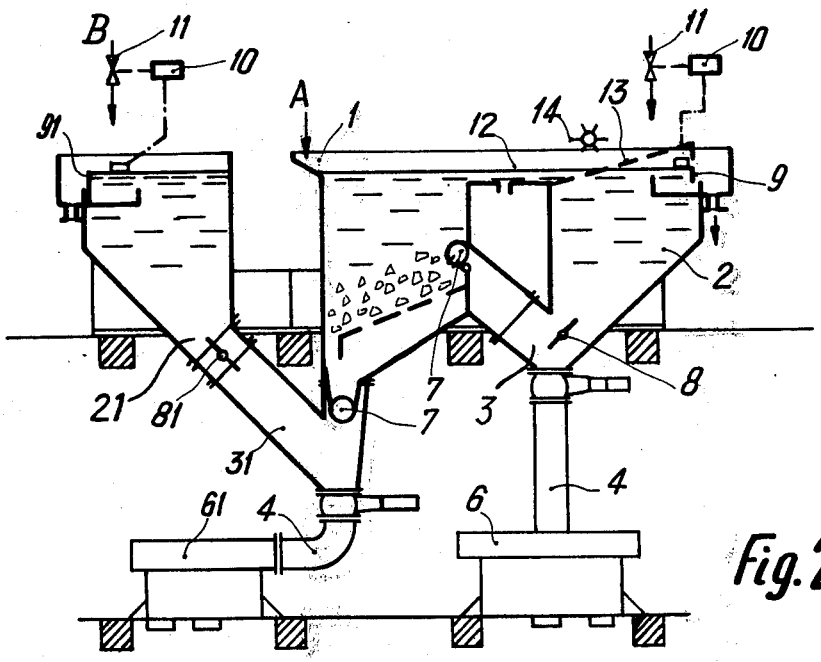
FIG. 2 is a vertical sectional view of the equipment consisting of one feeding tank and two equalizing tanks.

With the equipment as shown in FIG. 2, collecting and conveyance of two enriched products as received from the jigger is possible, the floating impurities being separated at a time. The flow-through system of communicating vessels comprises three tanks, viz. one feeding tank 1 being the two-product water jigger, and two equalizing tanks 2 and 21. The equalizing tank 2 is filled with effluent discharged via the open channel 12 from the jigger /i.e., the feeding tank 1/ and is used for collecting and conveyance of the light fraction, whereas the equalizing tank 21 is filled with pure water B utilized for collecting and conveyance of the heavy fraction. The raw mineral A and water is supplied to the feeding tank 1 /the jigger/, to be separated there into the light and heavy fractions. The light fraction, being deposited in form of the upper layer inside the tank 1, falls by gravity through the outlet /discharge/ hole in the tank 1 wall, into the communicating passage 3 filled with wash effluent, and therefrom /together with the effluent/ — via the offtake 4 — is discharged to the dewatering device 6. On the other hand, the heavy fraction falls by gravity, through the outlet hole in the bottom of tank 1 into the communicating passage 31 filled with pure /clean/ water, and together with the latter is discharged to the dewatering device 61. The heavy fraction discharge hole in the tank 1 is provided with restrictor 7 shaped in the form of a spherical and thus serving as a float valve. Within the communicating passages 3 and 31, regulating elements 8 and 81 are arranged to be used in particular circumstances when restriction of water outflow from the equalizing tanks 2 and 21 is required to cause water and products to flow out from the feeding tank 1. It may appear necessary upon prolonged shutdown of the equipment to flush the communicating passages 3. The equalizing tanks are equipped with control systems having regulators 10, whose function is to control the make-up water supply from the pipeline 11 should the water level inside the equalizing tanks 2 and 21 fall below that in the feeding tank 1.

With the equipment according to this invention, the floating impurities can also be separated from the wash effluent being discharged — via the open channel 12 — from the tank 1 to the tank 2. Such floating impurities are trapped by the catcher 14 provided above an inclined screen 13 covering the tank 2.

In order to maintain the predetermined higher level of water, the equalizing tanks are provided with overflow troughs. The overfall crest /edge/ 9 in the wash effluent tank 2, is located at the level of the water inside the feeding tank 1, the overfall crest 91 in the clean water tank 21 being arranged slightly above the water level in tank 1.

Figure 3:
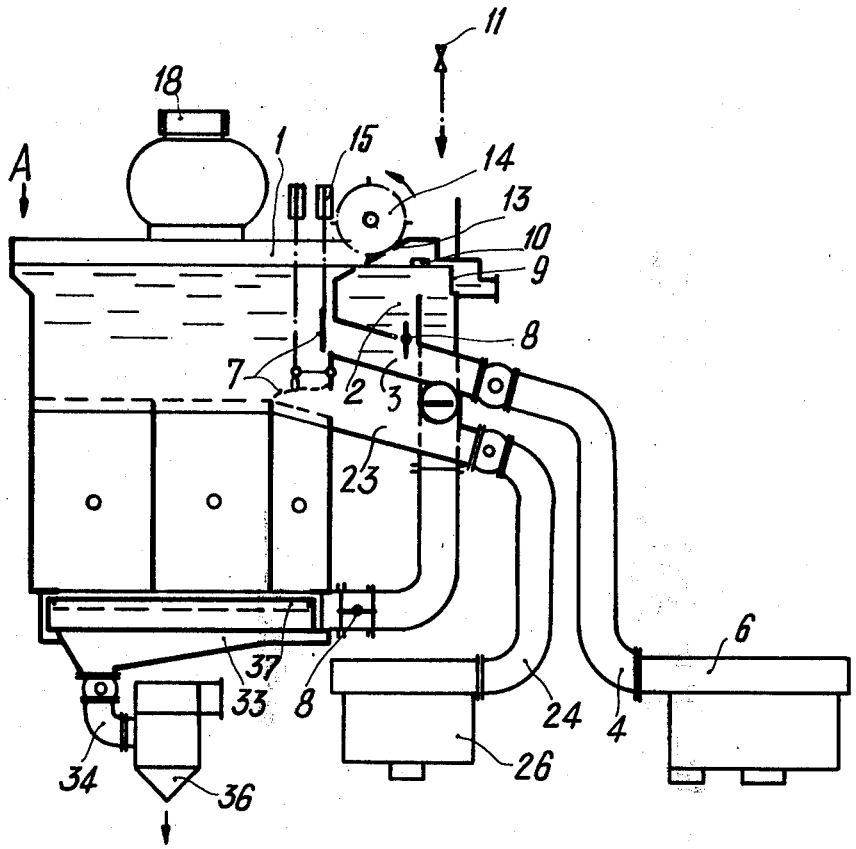
FIG. 3 is a vertical sectional view which shows the jigger complete with the means for collecting of enriched material.

FIG. 3 shows the equipment designed for collecting and conveyance of enriched products as received from the fines water jigger. The feeding tank 1 within the flow-through system of communicating vessels, is the jigger water box. Immediately behind the jigger overfall wall, the equalizing tank 2 is arranged to receive water from the jigger. The equalizing tank 2 communicates with the jigger 1 also via the passages 23 and 33.

In the jigger outlet holes leading to the said passages, restrictors 7 and 37 are provided. At the lowest sections of the passages 3, 23 and 33, offtakes 4, 24 and 34 are connected to discharge water and enriched material into the dewatering devices 6, 26, and 36. The equalizing tank 2 is covered by inclined screen 13, with the floating impurities catcher 14 arranged above the screen.

Moreover, the tank 2 has overflow crest 9 to discharge the water excess. The regulating system 10 inside the tank 2 is designed to control the make-up water supply from the pipeline 11. This make-up water will be needed in the case when the raw mineral and water A supplies have been temporarily limited, or when wash effluent from the enrichment process is considered as one of the products. To control the water flow from the jigger through the outlet holes, the regulating elements 8 in the equalizing tank 2 outlet /draining/ holes will be used. Setting of these elements 8 can be readjusted e.g. by means of servo-motors /actuators/ controlled from the pulsating valve 18. The position of the restrictors 7 /in particular outlet holes/ will be readjusted with the actuator 15 according to the actual thickness of the product layer within the jigger 1 water box, or according to the operating conditions of the dewatering devices 6 and 26. The restrictor 37 is diagrammetically shown in the form of a conventional flap valve and if the restrictor 37 is made in form of a cylindrical float, it can also be opened by closing the regulating element 8.

Raw material A together with water will be fed onto the jigger screen deck. By the influence of pulsating water on the screen deck, the light and heavy fractions become separated from the raw coal, some amount of fine grains being allowed under the screen deck. Water from the jigger 1 flows over the crest /edge/ into the equalizing tank 2. The light and heavy fractions are discharged by gravity from the jigger working trough via the outlet /discharge/ holes /complete with the restrictors 7/ located in the jigger front wall, and the underscreen product via the outlet hole /with the restrictor 37/ in the water box bottom. Since the restrictors 7 and 37 are components within the system of communicating vessels similar pressures prevail at both their sides, owing to which the products from the jigger water box are moved solely by gravity into the passages 3, 23 and 33. Constant and equal level of water in the jigger 1 and the equalizing tank 2 /due to application of the overfall crest 9 and the make-up water supply from the pipeline 11/ will prevent the water outflow from the jigger through its outlet holes. The products as received from the jigger, upon being transferred into the passages 3, 23 and 33, will flow by gravity down to the offtakes, and then become discharged into the dewatering devices 6, 26 and 36 provided with the inlet nozzles.

The dewatering devices 6, 26 and 36 are well known static facilities using the kinetic energy and centrifugal forces acting to the mixture of solid particles and liquid during its motion over the screen or screenless surface.

We claim:

1. Apparatus for gravity collection and handling of granular products comprising a feeding tank for receiving liquid containing granular materials to be separated therefrom, said feeding tank having a lower outlet, at least one equalizing tank having a lower outlet, a communicating passage connecting said feeding tank and said equalizing tank, a second passage connecting the outlets of said tanks, at least one discharge conduit connected to said second passage, a dewatering device having an inlet nozzle connected to said discharge conduit, a restrictor disposed at said outlet of the feeding tank for controlling flow therefrom, regulating means at the outlet of the equalizing tank for regulating discharge therefrom, said equalizing tank having an overflow crest located at a level at least as high as that of the liquid in the feeding tank.

2. Apparatus as claimed in claim 1 wherein said feeding tank has at least one second outlet and an associated restrictor, at least one of said restrictors comprising a float.

3. Apparatus as claimed in claim 1 wherein said communicating passage comprises an open channel.

4. Apparatus as claimed in claim 3 comprising an inclined screen covering said open channel.

5. Apparatus as claimed in claim 4 comprising means above said screen for removal of floating impurities in the liquid.

6. Apparatus as claimed in claim 1 wherein said discharge conduit has a cross-sectional area greater than that of the inlet nozzle of the dewatering device and smaller than that of said communicating passage.

7. Apparatus as claimed in claim 6 comprising a make-up water supply and means for regulating the minimum level of liquid in said equalizing tank by controlling flow of water from the make-up water supply to said equalizing tank.

* * * * *